US005228156A

United States Patent [19]

Wang

[11] Patent Number: 5,228,156

[45] Date of Patent: Jul. 20, 1993

[54] FLUID OPERATED DEVICE

[76] Inventor: John Wang, No. 129, Tuan-Chu Lane, Tuan-Chu Li, Chiayi City, Taiwan

[21] Appl. No.: 924,728

[22] Filed: Aug. 3, 1992

Related U.S. Application Data

[63] Continuation-in-part of Ser. No. 880,903, May 8, 1992.

[51] Int. Cl.[5] ..... A47C 27/08

[52] U.S. Cl. ..... 5/449; 5/450; 5/455; 36/35 B

[58] Field of Search ..... 5/449–453, 5/454, 455, 456; 36/29, 35 B; 128/DIG. 20

[56] References Cited

U.S. PATENT DOCUMENTS

| | | | |
|---|---|---|---|
| 2,004,906 | 6/1935 | Simister | 36/29 |
| 2,967,524 | 1/1961 | Christensen . | |
| 3,186,404 | 6/1965 | Gardna . | |
| 3,705,429 | 12/1972 | Nail | 5/455 |
| 3,755,820 | 9/1973 | Petrusek . | |
| 3,892,229 | 7/1975 | Taylor et al. . | |
| 4,100,635 | 7/1978 | Mitchell et al. | 5/452 |
| 4,628,911 | 12/1986 | Bornstein . | |
| 4,635,619 | 1/1987 | Diamond . | |
| 4,843,663 | 7/1989 | Horvat et al. | 5/455 |
| 4,860,397 | 8/1989 | Gusakov | 5/455 |
| 4,899,249 | 2/1990 | Laroco . | |
| 5,025,781 | 6/1991 | Ferrari . | |
| 5,054,145 | 10/1991 | Tsuchiya et al. | 5/451 X |
| 5,060,641 | 10/1991 | Tones . | |

*Primary Examiner*—Michael F. Trettel
*Attorney, Agent, or Firm*—Fish & Richardson

[57] ABSTRACT

A fluid operated device comprises a casing having an enclosing wall which is rigid at least in part to maintain a volume of said casing; a squeeze unit securely provided in said casing and having a squeezable wall confining a space; a fluid operating chamber formed in said casing around said squeezable wall to receive a first fluid which pressurizes said squeezable wall to perform a squeezing action; said enclosing wall further having at least one opening communicated with said space.

4 Claims, 3 Drawing Sheets

FLUID OPERATED DEVICE

This application is a continuation-in-part application of U.S. application Ser. No. 07/880,903 which was filed on May 8, 1992, still pending.

BACKGROUND OF THE INVENTION

1. Field of the Invention

The present invention relates to a fluid operated device, more particularly to a device which is simple in construction and which utilizes a pressurized fluid so as to achieve a variety of applications.

2. Brief Description of the Related Field

The application of fluid pressure, such as in pneumatic or hydraulic systems is known in the art. Generally, such pressure systems basically includes a fluid medium and a specific structure which cooperates with the fluid medium in order to achieve a specific function. For example, a hydraulic-cutting device employs a high pressure fluid to carry fine metal particles when performing a cutting operation. In another example, a water bed mattress is a mattress which is filled with water or other liquids to make the bed more comfortable and more resilient.

A conventional pressure system is designed to have a specific structure so as to effect a particular purpose. Therefore, the main object of this invention is to provide a fluid operated device which is simple in construction and which utilizes fluid pressure so as to achieve a wide variety of applications.

SUMMARY OF THE INVENTION

Accordingly, a fluid operated device of the present invention comprises a casing having an enclosing wall which is rigid at least in part to keep the casing from collapsing; a squeeze unit securely provided in the casing and having a squeezable wall which confines a space; and a fluid operating chamber formed in the casing around the squeezable wall to receive a first fluid which pressurizes the squeezable wall so as to perform a squeezing action. The enclosing wall further has at least one opening which is communicated with the space.

The enclosing wall of the casing can be entirely rigid or partially rigid to prevent the casing from collapsing so that, if air is used in the casing, a certain amount of air can be retained in the casing. Therefore, the air pressure required to generate a squeezing force via the squeezable wall can be achieved by supplying an amount of air to the casing in addition to the amount of air retained in the casing. It is easier to supply an added amount of air pressure rather than to supply the entire amount air pressure especially when a manual operation is employed.

BRIEF DESCRIPTION OF THE DRAWINGS

Other features and advantages of the present invention will be fully understood from the following detailed description of several preferred embodiments of the present invention with the accompanying drawings, wherein.

DETAILED DESCRIPTION OF THE PREFERRED EMBODIMENTS

Figure 1:
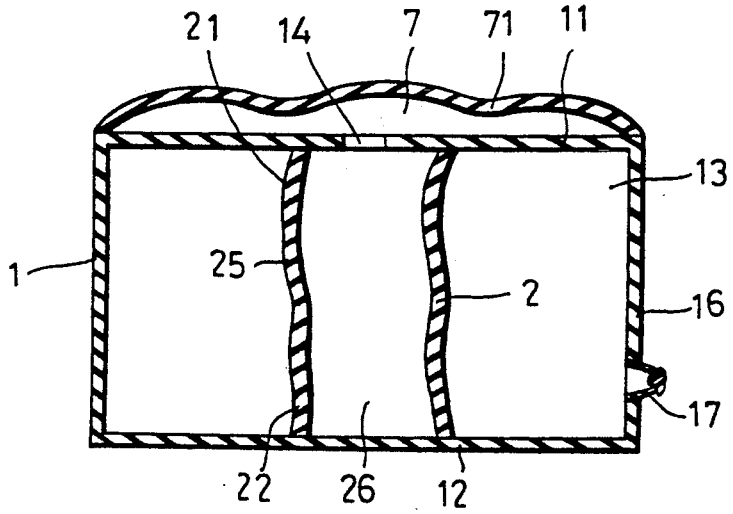
FIG. 1 illustrates a first embodiment of the invention.

The simplest and basic structure of the embodiment, the first embodiment of the present invention, is shown in FIG. 1, which comprises a casing (1) having a rigid and noncollapsible enclosing wall (16). The volume of the casing (1) can be large or small depending on the purpose of its application. The first embodiment also comprises a squeezable unit (2) which is securely provided in the casing (1) and has a squeezable wall (25) confining a space (26). In other words, the squeezable unit (2) in this embodiment is substantially a tubular body made of a fluid impervious sheeting, as best shown in FIG. 1, and has an upper end (21) and a lower end (22) which are attached respectively to an upper wall (11) and a lower wall (12) of the enclosing wall (16) of the casing (1). Also, the upper wall (11) is provided with an upper opening (14). By such arrangement, a chamber (13) is formed in the casing (1) around the squeezable unit (2). The chamber (13) is sealed everywhere by the enclosing wall (16) and the squeezable wall (25) except that a fluid inlet (17) is provided at the lateral wall of the enclosing wall (16) to permit a fluid to be introduced thereinto so as to create a fluid pressure. It can be noted that the chamber (13) and the space (26) confined in the squeezable wall (25) are not communicated with each other and that the space (26) is accessible via an opening (14) which is provided adjacent to the upper end (21).

Although the wall (25) has its two ends (21,22) attached to the casing in this embodiment, the squeezable wall may be in the form of a bag which has its one end attached to the wall of the casing (1) so that the bag is hung on the wall of the casing. It should be understood that the casing wall may be entirely rigid or partially rigid but sufficient to maintain a volume therein. The squeezable wall should be made of a flexible fluid impervious material such as a plastic, rubber or elastomeric material.

A flexible sheet (71) is connected to the casing (1) to form an inflatable article (7) which has a sealed chamber communicated with the upper opening (14) of the casing (1). The space (26) serves as a reservoir to receive a second fluid. The second fluid inflates the inflatable article (7) when the squeezable wall (25) is pressurized to squeeze the second fluid into the inflatable article.

Figure 2:
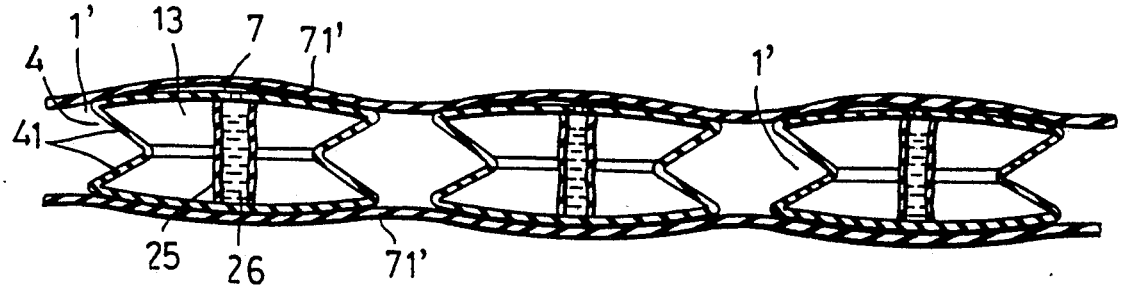
FIG. 2 illustrates a mattress incorporating a second embodiment of the invention, which is an application of the first embodiment.
Figure 3:
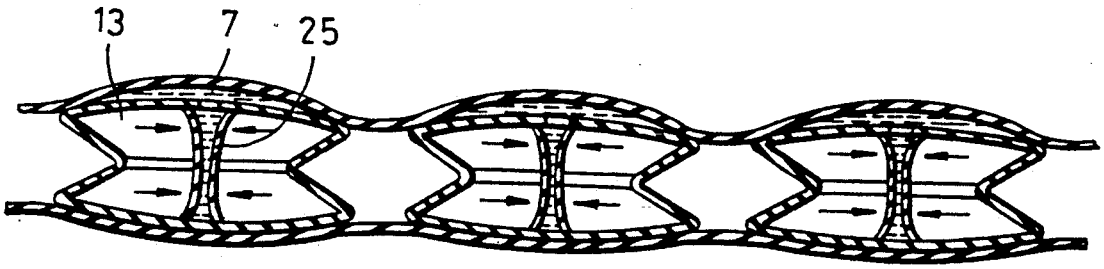
FIG. 3 illustrates the second embodiment of the invention in use.

FIGS. 2 and 3 show a mattress which is comprised of a plurality of fluid operated devices (1') of the present invention interconnected in a linear array by means of two flexible sheets (71'). The elements of this embodiment which are similar to those of the first embodiment are designated by the same numerals. Each fluid operated device (1') has a construction substantially similar to the construction of the device (1) of FIG. 1 except that the casing wall (4) of the device (1') is partially rigid so that it can be compressed to an extent. The casing wall (4) is configured to have two truncated cone-shaped parts (41) which have their restricted ends interconnected forming a neck at which the casing wall (4) becomes flexible. The enlarged opposite ends of the parts (41) are connected and sealed to the flexible sheets (71') respectively. The mattress further has a plurality of inflatable article (7) each of which is formed between the flexible sheet (71') and one end (11) of each fluid operated device (1'). When a first fluid is supplied from a source into the fluid operating chambers (13) of each device (1'), the squeezable wall (25) will squeeze the second fluid in the space (26) forcing a part of the second fluid into each inflatable article (7). The first fluid may be introduced into the devices (1') by using a tube means (not shown) which is communicated with all devices (1').

Figure 4:
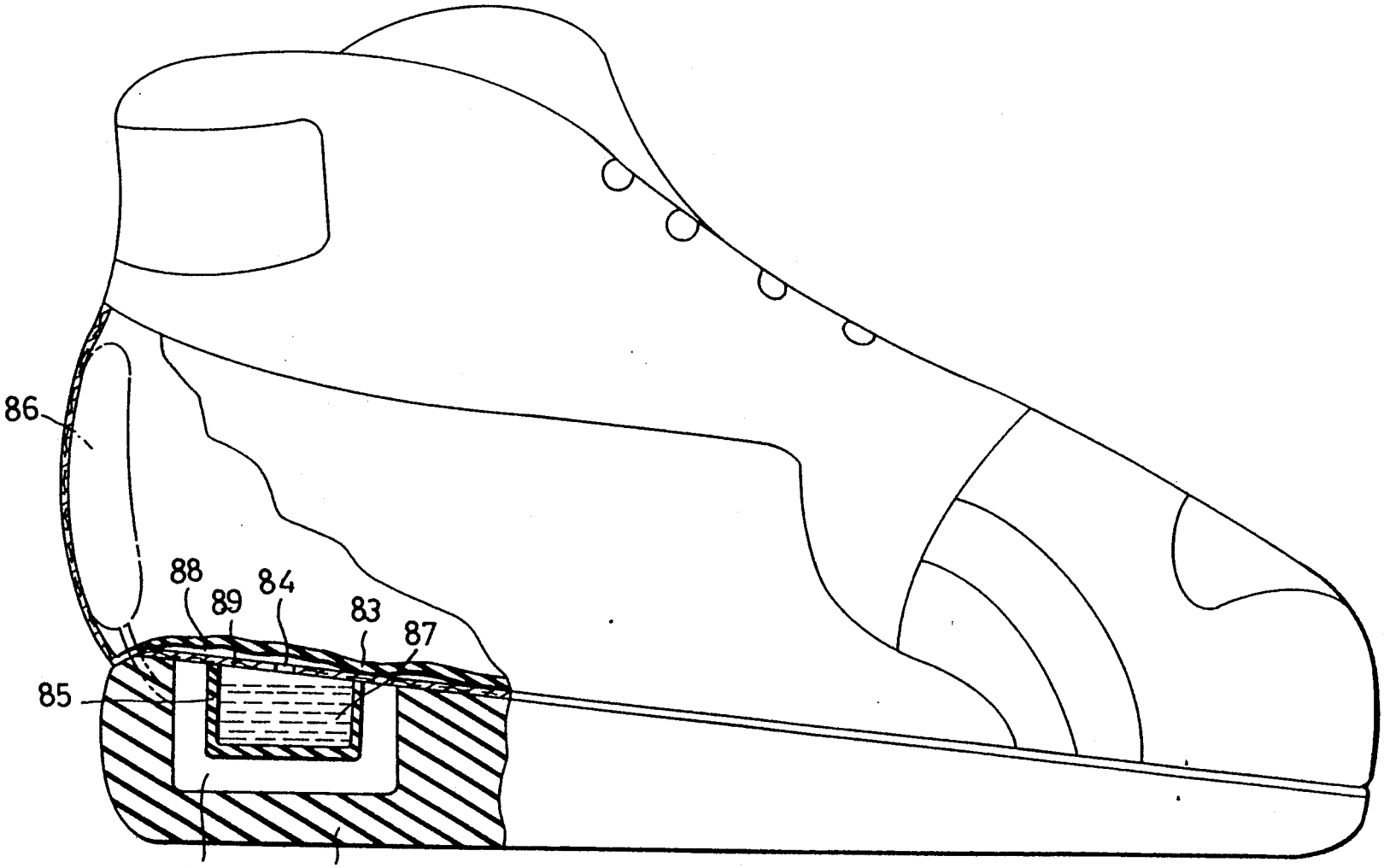
FIGS. 4 and 5 illustrate a shoe which incorporates a third embodiment of the invention.
Figure 5:
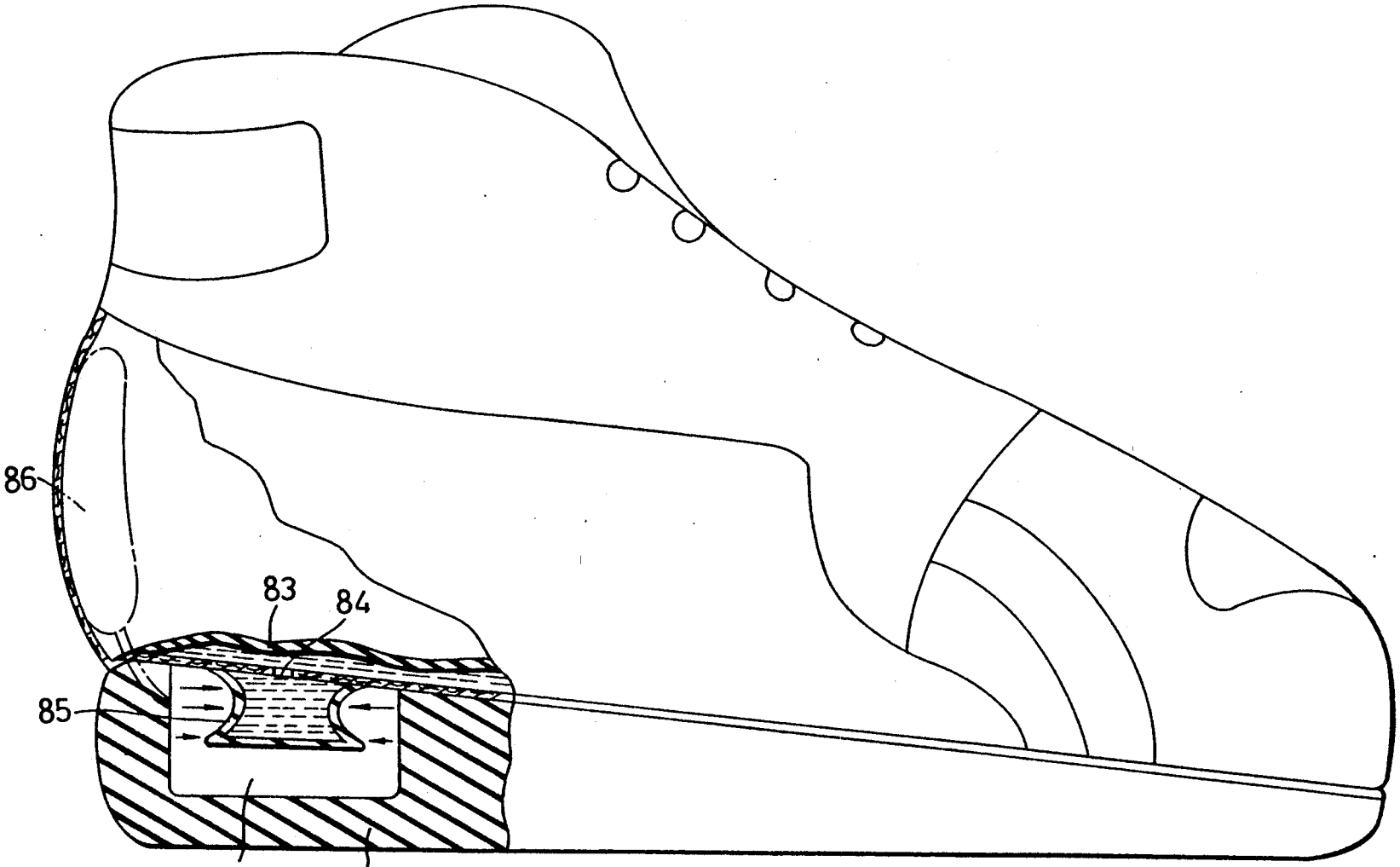

FIGS. 4 and 5 show a sport shoe such as a running shoe or a tennis shoe. A third embodiment of the fluid operated device is provided in the heel (8) of the sport shoe. The upper side of the heel (8) has a cavity (82) to serve as a fluid chamber. A plate (89) covers the cavity (82) and has an opening (84). A squeezable wall (85) is sealed to the plate (89) around the opening (84). A flexible sole (83) is provided above the plate (89) to confine a second fluid chamber (88) which is communicated with the fluid reservoir (87) via the opening (84). A pumping bulb (86) is mounted on the heel counter of the shoe and has a tubing communicating with the fluid operating chamber (82). Thus, in use, the heel of the foot of a user would intermittently compress the pumping bulb (86) to pump a first fluid, i.e., air into the fluid operating chamber (82) and create sufficient pressure therein to squeeze the squeezable wall (85), forcing the second fluid, a liquid, into the fluid reservoir (87) to enter the sealed chamber (88) through the opening (84) and to thereby inflate the sole (83). As such, the sole (83) which becomes resilient due to the fluid in the chamber (87) will be comfortable to the user. The fluid in the chamber (87) may also serve as a cooling medium to keep the sole cool.

From the above detailed description of the embodiments of the invention, it will be fully understood that this invention provides a fluid operated device which is simple in structure and which utilizes the fluid pressure in various applications.

It will be readily understood that modification to the preferred embodiments of the device of the invention described above would be obvious to anyone skilled in the art without departing from the scope of the appended claims.

What is claimed is:

1. A fluid operated device comprising:

a casing having an enclosing wall which is rigid at least in part to maintain a volume of said casing and which has a fluid inlet, a first end wall, and a second end wall opposite to said first end wall;

a squeeze unit securely provided in said casing and having a resiliently deformable wall defining a space, said resiliently deformable wall having a third end secured to said first end wall and an opposite fourth end secured to said second end wall;

a fluid operating chamber formed in said casing around said resiliently deformable wall to receive a first fluid which pressurizes said resiliently deformable wall to perform a deforming action;

said enclosing wall further having at least one opening communicating with said space;

an inflatable article connected to said casing and communicating with said opening, said space serving as a reservoir to receive a second fluid, said second fluid capable of inflating said inflatable article when said resiliently deformable wall is pressurized.

2. A fluid operated device as claimed in claim 1, wherein said enclosing wall has a wall part which is compressible and stretchable and which interconnects said first and second end walls, said wall part being stretchable to push said first and second end walls outward when a pressure is created in said fluid operating chamber to stretch said part.

3. A fluid operated device as claimed in claim 2, wherein said wall part includes two truncated cone-shaped members having restricted ends connected to one another, said truncated cone-shaped members having opposite enlarged ends connected to said first and second end walls respectively.

4. A fluid operated device as claimed in claim 1, further comprising a hand-operated pumping bulb connected to said fluid inlet.

* * * * *